US005904738A

United States Patent [19]

Purcell

[11] Patent Number: 5,904,738

[45] Date of Patent: May 18, 1999

[54] GAS-FADE INHIBITION

[75] Inventor: James E. Purcell, Charlotte, N.C.

[73] Assignee: Crompton & Knowles Corporation, Stamford, Conn.

[21] Appl. No.: 09/015,062

[22] Filed: Jan. 28, 1998

[51] Int. Cl.[6] ..... D06P 5/02; D06P 1/52

[52] U.S. Cl. ..... 8/442; 8/551; 8/921; 8/532

[58] Field of Search ..... 8/442, 536, 551, 8/639, 643, 662, 675, 116.1, 921, 529, 532

[56] References Cited

U.S. PATENT DOCUMENTS

| | | | |
|---|---|---|---|
| 2,246,511 | 6/1941 | Esselmann et al. | 106/40 |
| 2,567,130 | 9/1951 | Smith | 8/559 |
| 2,912,296 | 11/1959 | Taube et al. | 9/74 |
| 3,544,363 | 12/1970 | Rath et al. | 117/139.5 |
| 3,632,363 | 1/1972 | Moussalli | 106/170.44 |
| 3,794,464 | 2/1974 | Lofquist et al. | 8/551 |
| 3,952,131 | 4/1976 | Sideman | 428/334 |
| 3,988,292 | 10/1976 | Moriga et al. | 260/45.8 |
| 4,171,202 | 10/1979 | Sideman et al. | 8/2.5 |
| 4,224,212 | 9/1980 | Topham | 260/33.6 |
| 4,239,491 | 12/1980 | Baumgarte et al. | 8/532 |
| 4,443,223 | 4/1984 | Kissling et al. | 8/496 |
| 4,452,606 | 6/1984 | van Diest et al. | 8/496 |
| 4,520,143 | 5/1985 | Jellinek | 523/410 |
| 4,588,413 | 5/1986 | Keil et al. | 8/543 |
| 4,604,101 | 8/1986 | Kissling et al. | 8/551 |
| 4,619,665 | 10/1986 | Sideman et al. | 8/402 |
| 4,718,918 | 1/1988 | Heller et al. | 8/495 |
| 5,137,773 | 8/1992 | Malhotra | 428/215 |
| 5,364,462 | 11/1994 | Crystal et al. | 106/22 |
| 5,498,283 | 3/1996 | Botros et al. | 106/22 |
| 5,512,064 | 4/1996 | von der Eltz et al. | 8/541 |

FOREIGN PATENT DOCUMENTS

| | | |
|---|---|---|
| 50-71981 | 6/1975 | Japan . |
| 63-175186 | 7/1988 | Japan . |
| 1 429 512 | 3/1976 | United Kingdom . |
| 1 489 150 | 10/1977 | United Kingdom . |

*Primary Examiner*—Margaret Einsmann
*Assistant Examiner*—Brian Mruk
*Attorney, Agent, or Firm*—Raymond D. Thompson; Paul Grandinetti

[57] ABSTRACT

The invention is directed to (1) a method for increasing the color fastness of dyed textiles subject to exposure by atmospheric gases by treating said textiles with a fade-inhibiting amount of a composition comprising at least one polyalkylene imine and (2) the dyed textiles so treated.

10 Claims, No Drawings

GAS-FADE INHIBITION

BACKGROUND OF THE INVENTION

1. Field of the Invention

The present invention is directed to the inhibition of the fading of dyed textiles exposed to atmospheric gases.

2. Description of Related Art

A large number of synthetic polymers have been invented, many of which are useful as fibers that can be woven, knitted, and the like, into cloth. For convenience, such cloth and the fibers, filaments, or yarns used for making it will be referred to by the term "textiles." See *Merriam Webster's Collegiate Dictionary,* Tenth Edition, Merriam-Webster, Incorporated, Springfield, Mass., U.S.A., 1996, page 1220.

These textiles, in turn, are dyed by a wide variety of types of dyes, depending upon the physical characteristics of the particular textile and the end-uses to which it is directed. One type of dye, termed "disperse," was first developed in the early 1920's for the dyeing of cellulose acetate. These dyes are substantially insoluble in water but, in finely divided form, can be dispersed in aqueous medium and then allowed to dissolve in the fiber itself. Since their original discovery, disperse dyes have been used with a number of other textiles, including acrylic, modacrylic, cellulose triacetate, nylon, polyester, poylurethane, and polyolefin.

Disperse dyes are primarily low molecular weight anthraquinone, azo, and diphenylamine derivatives. They have a significant shortcoming in that, in the presence of certain atmospheric gases such as oxides of nitrogen, primarily nitrogen dioxide, their colorfastness, especially in the blue and grey regions of the spectrum, is poor. It is found that these colors tend, upon exposure to such gases, to change to hues of purple, pink, and red, a process known as "gas fading."

One known means for decreasing the susceptibility to gas fading lies in decreasing the basicity of the dye. Unfortunately, such methods have the drawback that the substituents that are used to do this impart inferior dyeing properties.

Alternatively, suitable inhibitors can be used to prevent fading. Early compounds were frequently of a slightly yellow color and often imparted undesirable shades to the dyed textile. In recent times, substantially colorless inhibitors, such as diphenylacetamidine, have been devised, and this problem has thus diminished.

Attempts to inhibit the yellowing or fading of polyurethanes by nitrogen oxide gas have used: long chain fatty acids, such as stearic acid or behenic acid (Japanese Patent Publication No. 22626/69); higher alcohols, such as n-decyl alcohol or stearyl alcohol (Japanese Patent Publication No. 31804/69); sulfur-containing higher fatty acid esters, such as lauryl thioethyl alcohol, dilauryl thiodipropionate, or distearyl thiodipropionate (Japanese Patent Publication No. 25909/69); long chain fatty acid amides, such as stearamide or palmitamide (Japanese Patent Publication No. 27874/69; ureas, such as, phenylurea or phenylthiourea (Japanese Patent Publication No. 19190/67); adipic acid dihydrazide and 2,4-bis-hydrazino-6-dimethylamino-s-triazine (Japanese Patent Publication No. 25828/68); hydrazides, such as adipic acid-bis-N,N-dimethyl hydrazide (Japanese Patent Publication No. 27348/65); semicarbazides, such as 1,1-dimethylstearyl-semicarbazide (Japanese Patent Publication No. 16793/66); phosphite esters, such as tridecyl phosphite or trilauryl thiophosphite, either alone or in combination with 2,4,6-tris-ethyleneimino-s-triazine or 2-phenyl-4,6-diamino-s-triazine (Japanese Patent Publication Nos. 9828/69, 29672/68, and 28625/68); hydroxphenyl compounds, such as 1,3,5-trimethyl-2,4,6-tris-(3,5-di-t-butyl-4-hydroxybenzyl)benzene (Japanese Patent Publication No. 16856/68); and polymeric compounds, such as poly(di-isopropylaminoethyl methacrylate) or poly (diethylaminoethyl methacrylate) (Japanese Patent Publication No. 2905/71).

In order to inhibit the fading or discoloration of cellulose acetates, there have been used primary, secondary, or tertiary amines, hydroxylamines, such as triethanolamine; heterocyclic compounds, such as phenyl morpholine, 1,4-dibenzyl morpholine, or N,N'-diphenyl piperazine; and compounds such as thiourea, melamine, N-acetyl melamine, N-phenyl melamine, 2,4-bis-anilino-6-amino-s-triazine, or triphenylmelamine.

U.S. Pat. No. 2,246,511 discloses the production of condensation or polymerization products by reacting alkyleneimines, polymeric alkyleneimines, and mixtures thereof with non-metal sulfides, such as carbon disulfide, thiophosgene, and sulfur chloride, and then introducing the polymerizates into spinning or casting solutions in a finely divided state.

U.S. Pat. No. 2,912,296 discloses that the fastness properties of dyeings with substantive dyestuffs can be improved to a considerable degree by aftertreating the dyeings with complex metal compounds of biguanides of polyalkylene imines, preferably of polyethylene imine.

U.S. Pat. No. 3,544,363 discloses textile cellulosic materials dyed or printed with sulfur dyestuffs and having improved wet fastness properties, wherein the materials contain from 0.1 percent to 5.0 percent by weight, based on the dry weight of the material, of a bis- or poly-$\alpha$, $\beta$-halohydrin compound containing at least one basic nitrogen atom.

U.S. Pat. No. 3,794,464 discloses that when about 0.3 percent to about 5 percent of polytertiary amines formed from the reaction of polyethylene imine with alkylene oxides are coated on nylon fiber, or are added to the dyebath, improved dyefastness is achieved compared to an untreated dyed nylon fiber when this fiber is exposed to ozone.

U.S. Pat. No. 3,988,292 discloses gas fade inhibitors for polyurethanes and cellulose acetates comprising triazine derivatives of a given formula and including, inter alia, 2,4-bis-allylamino-6-cyclohexylamino-s-triazine, 2(p-chloroanilino)4,6-bis-asym-dimethylhydrazino-s-triazine,2-dibenzylamino-4,6-bis-asym-dimethylhydrazino-s-triazine, 2,4-bis-allylamino-6-benzylthio-s-triazine, 2-diallylamino-6-benzylamino-6-methylthio-s-triazine, 2,4-bis-isopropylamino-6-(o-cresoxy)-s-triazine, and 2,6-bis-methylthio-4-cyclohexylamino-s-triazine.

U.S. Pat. No. 4,443,223 teaches that the fastness of direct dyes on cellulose substrates can be improved by aftertreatment with the reaction product of a quaternary polyalkylene polyamine with an N-methylol resin precursor, and heat curing in the presence of a catalyst. It is said that the unfixed portion of reactive dyes substantive to cellulose may also be given improved wet and light fastness by this treatment.

U.S. Pat. No. 4,452,606 teaches that the wet fastness of direct or reactive dyeings on cellulosic substrates can be improved by aftertreatment with a precondensate or mixture of (a) the product of reacting a polyalkylenepolyamine in free base or salt form with an epichlorohydrin or a precursor thereof, and (b) an N-methylol derivative of a urea, melamine, guanamine, triazinone, urone, carbamate or acid amide, in the presence of (c) a catalyst for the cross-linking of N-methylol compounds of the type (b) above, followed by a heat-curing step.

U.S. Pat. No. 4,588,413 teaches that improvements in the fastness properties of substrates dyed with reactive dyestuffs can be achieved by a dyeing aftertreatment with an agent that is the reaction product of polyethylene imine and a bifunctional alkylating agent.

U.S. Pat. No. 4,604,101 teaches that dyeings on hydroxy group- or nitrogen-containing fibers can be improved by aftertreatment, simultaneously or sequentially, with (a) a polymeric reaction product of an amine with cyanamide, dicyandiamide, guanidine or bisguanidine and (b) a quaternary polyalkylene polyamine.

U.S. Pat. No. 4,718,918 discloses polymeric compounds obtained by the reaction of epihalo-hydrin with a polyalkylene polyamine that are said to be useful as textile treatment agents. As pretreatment agents they improve the color yield of the subsequent dyeing, and as aftertreatment agents they improve fastness properties.

U.S. Pat. No. 5,512,064 discloses fiber materials that are modified with a polyalkylene imine polymer and a crosslinking agent, preferably glyoxal, and optionally dyed with water-soluble, anionic dyes, preferably reactive dyes. The dyeing process with the so modified fiber materials can be carried out low-salt or completely without salt and also alkali-free or with minimal amounts of alkali.

SUMMARY OF THE INVENTION

The present invention is directed to the use of an imino compound to inhibit the fading of dyed textiles upon exposure to atmospheric gases.

More particularly, the present invention relates to a method for increasing the color fastness of dyed textiles subject to exposure to atmospheric oxides of nitrogen by treating said textiles with a fade-inhibiting amount of a composition comprising at least one polyalkylene imine.

In another aspect, the present invention relates to a dyed textile having increased color fastness upon exposure to atmospheric oxides of nitrogen, said textile having been treated with a fade-inhibiting amount of a composition comprising at least one polyalkylene imine.

DESCRIPTION OF THE PREFERRED EMBODIMENTS

As stated above, the present invention relates to (1) a method for increasing the color fastness of dyed textiles subject to exposure to atmospheric gases by treating said textiles with a fade-inhibiting amount of a composition comprising polyalkylene imine or a mixture of polyalkylene imines and (2) the dyed textiles so treated.

Cellulose esters have been known since the nineteenth century. In 1865, cellulose triacetate was prepared by Schytzenberger on a laboratory scale, and Cross et al. described a commercial process in 1894. During the First World War, a factory was built in England to produce a dope for use in aircraft that was what is now known as secondary acetate. After the war, this factory was converted to a facility for the production of fibers under the name "Celanese."

In cellulose triacetate, substantially all of the available hydroxyl groups of the glucose residue of the cellulose (three hydroxyl groups per glucose residue) are acetylated. In secondary acetate, on the other hand, between 2.3 and 2.4 of the available hydroxyl groups are, on the average, acetylated. It is this material that is now generally referred to as "cellulose acetate."

Once secondary acetate textiles were introduced, it was necessary to find appropriate dyes for them. Disperse dyes were found to be especially useful but suffered from the drawback that they were susceptible to fading upon exposure to the fumes from gas heaters. Red and blue dyes based on aminoanthraquinone were particularly problematic, but azo dyes were also found to give trouble, although to a lesser degree. The active principle in the heater fumes that caused the fading was found to be oxides of atmospheric nitrogen. A number of studies were carried out in an effort to find the solution to this problem, and these led to the discovery of inhibitors of various kinds that were capable of providing at least some improvement.

Although the gas-fading problem is particularly acute in the case of secondary acetate, i.e., cellulose acetate, it is also experienced, generally to a lesser extent, where disperse dyes are used with other textiles, for example, cellulose triacetate, polyesters, nylons, polyurethanes, and the like.

Although the inhibitors that have been discovered since the advent of secondary acetate have improved the color fastness of the dyed textiles upon exposure to atmospheric gases to a substantial extent, there remains a need in the industry for new and improved compounds for this purpose.

The present invention is directed to the use of polyalkylene imines as inhibitors of the gas-fading from atmospheric oxides of nitrogen, which remains a problem for textile manufacturers who use disperse dyes.

The polyalkylene imines of the present invention are preferably those wherein the "alkylene" refers to an alkylene group containing two or more carbon atoms, including, but not limited to, ethylene, propylene, butylene, and isomers thereof. A preferred polyalkylene imine is polyethylene imine, which is commercially available in either a substantially linear form or a branched form. For example, a highly branched form can be employed wherein at least 20 percent of the nitrogen atoms are present in tertiary amine groups. The molecular weight of suitable polyalkylene imines is generally greater than 500, preferably greater than 5,000, more especially in the range of from 5,000 to 250,000. Stated another way, the polyalkylene imine may have from about 3 to about 58,000 monomer units.

Exemplary polyethylene imines include, but are not limited to, those represented by the following:

(1) linear polyethylene imines of the formula $$R^1\text{-}(CH_2CH_2NH)_nR^2$$

where $R^1$ and $R^2$ are chain terminating groups, such as alkyl, hydroxyalkyl, aminoalkyl, $NH_2$, hydrogen, and the like, and n is an integer greater than 1; and (2) branched polyethylene imines of the formula $$R^3\text{-}(CH_2CH_2NR^4)_yR^5$$

where $R^3$ and $R^5$ are chain terminating groups, such as alkyl, hydroxyalkyl, aminoalkyl, $NH_2$, hydrogen, and the like; y is an integer greater than 1; and $R^4$ is $—(CH_2NH)_z$, $—(CH_2CH_2NH)_zR^6$, $—(CH_2CH_2CH_2NH)_zR^6$, $—(CH_2CH_2CH_2CH_2NH)_zR^6$, or higher $CH_2$ polymers or isomers thereof, where $R^6$ is a chain terminating group, such as alkyl, hydroxyalkyl, aminoalkyl, $NH_2$, hydrogen, and the like; and z is an integer greater than 1; or $R^4$ is alkyl of one or more carbon atoms, including, but not limited to, methyl, ethyl, propyl, butyl, and isomers thereof.

Linear polyalkylene imines are commercially available from Crompton & Knowles Colors Incorporated under the trade designation Intratex DLM. In the practice of the present invention, linear polyethylene imines are preferred.

The polyalkylene imine inhibitors of the present invention are useful for inhibiting the gas-fading of disperse dyes, such as those prepared from anthraquinone, azo, diphenylamine, and benzodifuranone derivatives, from hydrophobic textiles, such as cellulose acetate, cellulose triacetate, nylons, polyesters, polyurethanes, acrylics, modacrylics, polyolefins, and the like. In such hydrophobic textiles, the disperse dyes, which are nonionic, are absorbed from their dispersion into the fibers where they form a solid solution. The preferred textiles for application of the inhibitors of the present invention are cellulose acetate and cellulose triacetate, including blends of the two, since these materials generally exhibit the greatest gas-fading problems. Most preferred is cellulose acetate. The cellulose acetate and/or cellulose triacetate may, if desired, be blended with other fibers that are susceptible to treatment by the process of the present invention or with fibers that are not so susceptible. For example, the cellulose acetate and/or cellulose triacetate may be blended with rayon; polyester; Nylon Type 6; Nylon Type 6,6; cotton; and the like. Further, disperse dyes that are based on anthraquinone derivatives exhibit the greatest tendency to fade under the influence of atmospheric gases and, thus, the inhibitors of the present invention will most profitably be applied to them.

The gases that bring about the fading that can be prevented or reduced by the application of the present invention are generally oxides of nitrogen, e.g., nitrous oxide, nitric oxide, nitrogen sesquioxide, nitrogen dioxide, dinitrogen tetroxide, dinitrogen pentoxide, and the like and mixtures thereof. Of these, nitric oxide and nitrogen dioxide, especially the latter, are generally considered to be the primary causes of gas-fading in dyed textiles. It is in situations where it is likely that a dyed textile will come into contact with one of these oxides that the present invention is most beneficially applied.

The inhibitors of the present invention can be applied to textile materials from liquors containing them by processes such as spraying, brushing, padding, dipping, and the like. The inhibitors may also be applied to the textile materials by exhaustion.

One technique of application involves immersing a textile in a bath of the inhibitor of the invention, then passing it through squeeze rolls so as to leave 30 percent to 100 percent by weight of the bath on the textile and then drying to remove solvent. The inhibitor is incorporated into the textile polymer in an amount preferably no more than 10 percent by weight, preferably about 0.3 percent to about 8 percent by weight based on the weight of the polymer. If the amount is below about 0.3 percent by weight, the effect of the inhibitor is lowered, and if it is above 10 percent by weight, the properties of the polymer, such as tenacity or elongation, tend to be reduced. The actual amount of the inhibitor to be employed will depend upon the nature and quantity of the dye used, but an amount on the order of from about 1 to about 5 weight percent actually in the fiber is generally most preferred for use with dyes that are sensitive to fading.

Another method by which the inhibitors of the present invention can be applied involves exhaustion from a dye bath. This method is particularly suited to treating knitted garments, but it may be used for treating very long lengths of woven textile materials in all types of dyeing equipment.

The rate of exhaustion of the compositions may be accelerated by the addition of up to 2 g/L of a nonionic surfactant or water soluble polymer. In a preferred case, a nonionic surfactant that is essentially soluble in cold water and has a cloud point of less than 90° C. is used. Suitable nonionic surfactants include alkylphenoxypolyethoxyethanols containing eight to nine carbon atoms in the alkyl group and from 4 to 15 oxyethylene groups, alkoxypolyethoxyethanols containing from 9 to 18 carbon atoms in the alkyl group and from 4 to 15 oxyethylene groups, or various block copolymers of polyethyleneoxide and polypropyleneoxide. Preferred nonionic water soluble polymers are those having an inverse solubility-temperature relationship in water, examples of which include polyvinyl methyl ether, polyisopropylacrylamide, and cellulose methyl ethers. After the bath has essentially cleared (i.e., the inhibitor of the invention has exhausted onto the textile material), the textile material is removed from the bath and dried. Before drying, it is usual practice to remove as much excess water as possible by, for example, squeezing, pressing, or hydro-extracting.

The gas-fade inhibitor of the present invention may be incorporated into the starting monomers before initiation of addition polymerization for producing synthetic polymers, or it may be added at the initiation of, during, or after the end of the polymerization reaction. It is especially preferred to mix and disperse it in the polymer. In the case of cellulose acetates, it may be mixed with the flakes of cellulose acetates, or with a spinning mass obtained by dissolving the cellulose acetate polymer in an organic solvent, such as acetone, ethylene dichloride, or dimethyl formamide.

Furthermore, it may be added before or during the shaping of the polymer. It is also possible to contact a shaped article of the polymer, e.g., a fiber or the like, with a solution or aqueous emulsion of the gas-fade inhibitor by such means as immersion or spray. Moreover, the inhibitor may be added in a dye bath and incorporated into the polymer at the same time as the dye. In short, the gas-fade inhibitor of the present invention can be incorporated into the polymer at any desired stage from the production of the polymer to the finishing of a shaped article thereof. The solvent used for producing the solution of the inhibitor may, for example, be a lower aliphatic alcohol, such as methanol, ethanol, propanol, or isopropanol, or a relatively low boiling halogenated hydrocarbon, such as carbon tetrachloride, chloroform, tetrachloroethylene, or trichloroethylene. These solvents may also serve to disperse the inhibitor in the polymer. The emulsifying agent used to form the aqueous emulsion may, for example, be a nonionic surface active agent of an anionic surface active agent used either alone or in combination. Specific examples are sodium dodecylbenzene sulfonate, lauryl sulfate, alkylphenol/ethylene oxide adducts obtained by the addition of 10 to 30 mols of ethylene oxide to an alkylphenol whose alkyl group contains 8 to 15 carbon atoms. These emulsifying agents are preferably used in admixture in order to improve the stability of the emulsion.

The most preferred method of incorporating the gas-fade inhibitor of the present invention is to add the inhibitor before the fabrication of the polymer, thereby imparting a gas-fade inhibiting effect to the polymer itself. Generally, the gas-fade-inhibiting activity is more durable when the inhibitor is incorporated into the polymer than when it is incorporated in the step of dyeing a shaped article of the polymer, or thereafter.

Various features and aspects of the present invention are illustrated further in the examples that follow. While these examples are presented to show one skilled in the art how to operate within the scope of the invention, they are not intended in any way to serve as a limitation upon the scope of the invention.

EXAMPLES

Polyethylene imine was applied continuously by padding the product onto dyed acetate fabric cold and drying the fabric at 175° F. The acetate fabric was dyed with disperse dyes, which are the most vulnerable to fading when exposed to burnt gas fumes. The following dyes or combinations of dyes were used for evaluating the polyethylene imine:

1.00 percent Intrasperse Red Violet RH New 90 percent (Disperse Violet 1);

1.00 percent Intrasperse Brilliant Blue B Supra (Disperse Blue 3);

0.20 percent Intrasperse Yellow GBA Ex Conc. (Disperse Yellow 3) in combination with 0.50 percent Intrasperse Brilliant Blue B Supra (Disperse Blue 3).

Two black shades were used that were made with different dye combinations. The first black shade was made with Intrasperse Blue GFD 150 percent (Disperse Blue 102), which has very good gas fastness. The second black shade was made with Intrasperse Blue BG, which has very poor gas fastness. The black shade made with Intrasperse Blue BG was treated with polyethylene imine in an effort to give it the same gas fastness as the black shade made with Intrasperse Blue GFD 150 percent. The compositions of the two black shades were:

First black shade:

2.40 percent Intrasperse Blue GFD 150 percent (Disperse Blue 102), 0.912 percent Intrasil Brown 3R (Disperse Brown 1);

Second black shade:

2.56 percent Intrasperse Blue BG (Disperse Blue 3), 0.96 percent Intrasil Brown 3R (Disperse Brown 1), 0.96 percent Intrasil Red FTS (Disperse Red 177).

Specimens of the dyed acetate fabric that had been aftertreated with polyethylene imine, specimens of the same fabric that had not been treated, and a test control fabric were exposed simultaneously to oxides of nitrogen from burnt gas fumes until the control showed a change in color corresponding to that of the standard of fading, according to AATCC Test Method 23-1994, incorporated herein by reference in its entirety.

In this test method, the change in color of the specimen is assessed with a standard gray scale for assessing change in color. If no color change is observed in the specimen after one exposure period or cycle, exposure may be continued, for either a specified number of periods or for the number of periods required to produce a specified amount of color change in the specimen. At the end of each exposure period or cycle, each specimen is taken from the exposure chamber and compared to the preserved original from which it was drawn. Each specimen is rated for change in color using the Gray Scale for Color Change.

The Gray Scale comprises:

Grade 5—Negligible or no change as shown in Gray Scale Step 5;

Grade 4.5—A change in color equivalent to Gray Scale Step 4–5;

Grade 4—A change in color equivalent to Gray Scale Step 4;

Grade 3.5—A change in color equivalent to Gray Scale Step 3–4;

Grade 3—A change in color equivalent to Gray Scale Step 3;

Grade 2.5—A change in color equivalent to Gray Scale Step 2–3;

Grade 2—A change in color equivalent to Gray Scale Step 2;

Grade 1.5—A change in color equivalent to Gray Scale Step 1–2;

Grade 1—A change in color equivalent to Gray Scale Step 1.

The rating given to each tested specimen follows:

| | Gas Fade | | Shade | Lightfastness | |
|---|---|---|---|---|---|
| | 1 Cycle | 2 Cycles | Alter. | 10 Hrs. | 20 Hrs. |
| 1.00 Percent Intrasperse Red Violet RH New 90 Percent | | | | | |
| Control - No Aftertreatment | 2 | 1 | | 4–5 | 4 |
| 40.0 g/l Polyethyleneimine | 5 | 4–5 | 4–5 red | 4–5 | 4 |
| 1.00 Percent Intrasperse Brilliant Blue Supra | | | | | |
| Control - No Aftertreatment | 2 | 1 | | 5 | 4–5 |
| 40.0 g/l Polyethyleneimine | 5 | 4–5 | 3 red | 5 | 4–5 |
| 0.20 Percent Intrasperse Yellow GBA Ex. Conc. 0.50 percent Intrasperse Brilliant Blue B Supra | | | | | |
| Control - No Aftertreatment | 1–2 | 1 | | 4–5 | 4 |
| 40.0 g/l Polyethyleneimine | 5 | 4–5 | 3 red | 4 | 3–4 |
| 2.56 Percent Intrasperse Blue BG 0.96 Percent Intrasil Brown 3R 0.96 Percent Intrasil Red FTS | | | | | |
| Control - No Aftertreatment | 2–3 | 1 | | 4 | 3–4 |
| 20.0 g/l Polyethyleneimine | 4–5 | 4 | 4 red | 4 | 3–4 |
| 40.0 g/l Polyethyleneimine | 4–5 | 4 | 4 red | n/a | n/a |
| 2.40 Percent Intrasperse Blue GFD 150 Percent 0.912 percent Intrasil Brown 3R | | | | | |
| Control - No Aftertreatment | 4–5 | 4–5 | | 3 | 2–3 |
| 20.0 g/l Polyethyleneimine | 5 | 5 | 4 red | 3–4 | 3 |
| 40.0 g/l Polyethyleneimine | 5 | 5 | 4 red | n/a | n/a |

In view of the many changes and modifications that can be made without departing from principles underlying the invention, reference should be made to the appended claims for an understanding of the scope of the protection afforded the invention.

What is claimed is:

1. A method for increasing the color fastness of dyed textiles selected from the group consisting of cellulose acetate, cellulose triacetate, and a blend thereof, wherein said textiles are subject to exposure, after dyeing with a disperse dye, to atmospheric oxides of nitrogen selected from the group consisting of nitrous oxide, nitric oxide, nitrogen sesquioxide, nitrogen dioxide, dinitrogen tetroxide, dinitrogen pentoxide, and mixtures thereof, comprising treating said textiles prior to said exposure with a fade-inhibiting amount of a composition including at least one polyalkylene imine selected from the group consisting of a linear polyethylene imine of the formula $$R^1—(CH_2CH_2NH)_nR^2$$

wherein $R^1$ and $R^2$ are chain terminating groups and n is an integer greater than 1 and a branched polyethylene imine of the formula $$R^3—(CH_2CH_2NR^4)_yR^5$$

wherein $R^3$ and $R^5$ are chain terminating groups, y is an integer greater than 1, and $R^4$ is $—(CH_2NH)_z$, $—(CH_2CH_2NH)_zR^6$, $—(CH_2CH_2CH_2NH)_zR^6$, $—(CH_2CH_2CH_2CH_2NH)_zR^6$, or higher $CH_2$ polymers, or isomers thereof, where $R^6$ is a chain terminating group and z is an integer greater than 1, or $R^4$ is alkyl of one or more carbon atoms.

2. The method of claim 1 wherein the disperse dye is an anthraquinone, azo, diphenylamine, or benzodifuranone derivative.

3. The method of claim 1 wherein the textile is cellulose acetate.

4. The method of claim 1 wherein the textile is further blended with at least one textile selected from the group consisting of rayon; polyester; Nylon Type 6; Nylon Type 6,6; and cotton.

5. The method of claim 1 wherein the oxide of nitrogen is nitrogen dioxide.

6. A dyed textile composition having increased color fastness when said composition, after dyeing with a disperse dye, is exposed to atmospheric oxides of nitrogen selected from the group consisting of nitrous oxide, nitric oxide, nitrogen sesquioxide, nitrogen dioxide, dinitrogen tetroxide, dinitrogen pentoxide, and mixtures thereof, said textile composition comprising cellulose acetate, cellulose triacetate, and a blend thereof having been treated with a fade-inhibiting amount of at least one polyalkylene imine selected from the group consisting of a linear polyethylene imine of the formula $$R^1—(CH_2CH_2NH)_nR^2$$

wherein $R^1$ and $R^2$ are chain terminating groups and n is an integer greater than 1 and a branched polyethylene imine of the formula $$R^3—(CH_2CH_2NR^4)_yR^5$$

wherein $R^3$ and $R^5$ are chain terminating groups, y is an integer greater than 1, and $R^4$ is $—(CH_2NH)_z$, $—(CH_2CH_2NH)_zR^6$, $—(CH_2CH_2CH_2NH)_zR^6$, $—(CH_2CH_2CH_2CH_2NH)_zR^6$, or higher $CH_2$ polymers, or isomers thereof, where $R^6$ is a chain terminating group and z is an integer greater than 1, or $R^4$ is alkyl of one or more carbon atoms.

7. The textile composition of claim 6 wherein the textile comprises cellulose acetate.

8. The textile composition of claim 6 wherein the composition further comprises at least one textile selected from the group consisting of rayon; polyester; Nylon Type 6; Nylon Type 6,6; and cotton.

9. The textile composition of claim 6 wherein the oxide of nitrogen is nitrogen dioxide.

10. The textile composition of claim 6 wherein the disperse dye is an anthraquinone, azo, diphenylamine, or benzodifuranone derivative.

* * * * *